United States Patent [19]

Berney

[11] Patent Number: 4,942,720

[45] Date of Patent: Jul. 24, 1990

[54] BOTTOM CASE LOADER AND METHOD

[76] Inventor: Joseph C. Berney, 8755 Caminito Abrazo, La Jolla, Calif. 92037

[21] Appl. No.: 225,862

[22] Filed: Jul. 29, 1988

[51] Int. Cl.[5] ..... B65B 5/10; B65B 35/30; B65B 35/40; B65B 35/50

[52] U.S. Cl. ..... 53/447; 53/247; 53/473; 53/535; 53/540; 53/543

[58] Field of Search ..... 53/242, 447, 448, 535, 53/537, 538, 540, 543, 243, 247, 473

[56] References Cited

U.S. PATENT DOCUMENTS

| | | | |
|---|---|---|---|
| 1,269,115 | 6/1918 | Reese | 53/535 |
| 2,024,503 | 11/1933 | Bickford | 53/537 X |
| 3,350,836 | 11/1967 | Dillon et al. | 53/242 X |
| 3,659,726 | 5/1972 | Anderson | 53/537 X |
| 3,917,080 | 11/1975 | Jones | 414/46 |
| 4,633,653 | 1/1987 | Roberts et al. | 53/535 X |

*Primary Examiner*—Robert L. Spruill
*Assistant Examiner*—Linda B. Johnson
*Attorney, Agent, or Firm*—Calif Kip Tervo

[57] ABSTRACT

A machine for loading one or more layers of product into a case from the bottom. The machine loads a first layer of received product into a product arrangement area onto an elevator platen. The platen is lowered and a slip sheet is inserted to be the floor of the arrangement area. A subsequent layer of product is arranged on the slip sheet. The slip sheet is withdrawn and the product layer thereon drops onto the layer on the lowered platen. Subsequent layers can be added accordingly. When all of the layers are stacked on the platen, then the elevator platen is raised to insert the stacked product thereon into an open case above the arrangement area. The case may be closed and sealed.

9 Claims, 1 Drawing Sheet

BOTTOM CASE LOADER AND METHOD

BACKGROUND OF THE INVENTION

This invention relates in general to loading a case with a product and more particularly to a loader for loading one or more layers of containers into a corrugated shipping case which is open on the bottom.

SUMMARY OF THE INVENTION

The invention is a case loader for receiving product and for loading a stack of layers of product into a case from underneath the case. The loader is intended to be located at the end of a product assembly line to receive the produced product and is intended to be incorporated into a case packing machine such as disclosed in this inventor's U.S. Pat. No. 3,979,878 titled "Container Accumulating Apparatus".

In the exemplary embodiment, the bottom loader loads a layer of received product into a product arrangement area in the following manner. It receives product, such as from a conveyor belt, and accumulates a row of product in front of a pusher plate. The pusher plate then pushes the row of product into a product arrangement area. The pusher plate is then retracted to receive and accumulate a subsequent row of product. The subsequent row is pushed into the arrangement area adjacent the previous row. This procedure is repeated until the arrangement area is full.

Alternately, product can be accumulated in any of several manners including that described in the above-referenced patent.

When the arrangement area is full, the pusher plate may be retained adjacent the last loaded row to act as that guiding wall of the arrangement area during layer raising and lowering operations.

At the time the first layer of product is loaded into the arrangement area, the floor of the arrangement area is an elevator platen. The elevator platen along with the first layer of product thereon, is then lowered to a lower position such that the first layer can receive an additional layer of product.

A slip sheet is inserted thru a slot in the back wall of the arrangement area to serve as the floor of the arrangement area. A subsequent layer of product is arranged, as described above, on the slip sheet. The slip sheet is retracted outside of the arrangement area such that each subsequent layer of product thereupon drops a small fraction of an inch onto the layer of product previously formed.

If more product layers are to be stacked, the elevator is lowered and the slip sheet is again inserted to receive another layer. When the last layer of product is on the stack, then the elevator platen is raised to insert the stacked product thereon into an open case above the arrangement area. The bottom flaps of the case may be closed as taught in this inventor's U.S. Pat. No. 3,808,770 titled "Casing Machine and Method". The top flaps are closed and the case is sealed by conventional means.

When only one layer of product is to be packed, the slip sheet mechanism is omitted and the elevator deck raises the product array directly up into the case.

Other features and many attendant advantages of the invention will become more apparent upon a reading of the following detailed description together with the drawings, in which like reference numerals refer to like parts throughout.

DETAILED DESCRIPTION OF THE INVENTION

Figure 1:
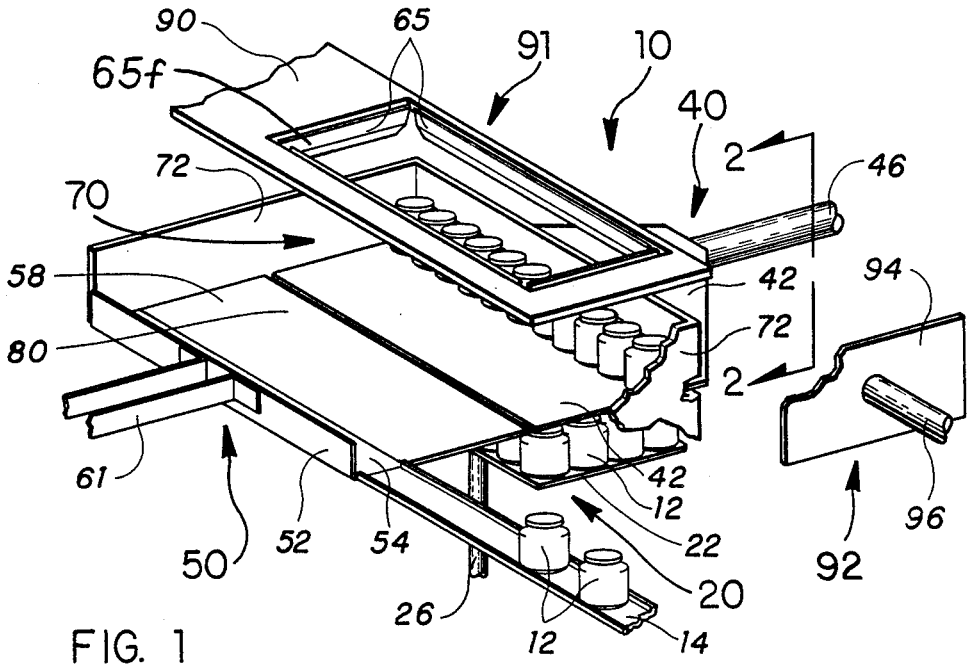
FIG. 1 is a perspective view, partially cut away, of the principal components of an exemplary embodiment of the bottom case loader of the present invention.

With reference now to the drawing, and more particularly to FIG. 1 thereof, there is a perspective view of the major components of an exemplary embodiment of the bottom case loader, denoted generally as 10, of the present invention. Bottom case loader 10 is intended to be a component of an entire case loading and sealing system apparatus, such as exemplified in this inventor's previous patents: U.S. Pat. No. 3,979,878, titled "Container Accumulating Apparatus", U.S. Pat. No. 3,808,770, titled "Casing Machine and Method", and U.S. Pat. No. 3,435,738 titled "Foldable Case Setup Apparatus". Therefore, for purposes of simplicity and clarity, many of the features of such apparatuses are not shown. For example, the bottom case loading components 10 are supported by an appropriate frame structure, and their movements would typically be controlled by a central control circuit by any of several means well known to those skilled in the art. Additionally, the various drive means, such as pneumatic cylinders, electric motors, ect., for the moving features are not described in detail as these are well known in the art. Also, the art and methods of position sensing and of object sensing are well known in the art. Therefore, the overall frame structure, control circuitry, drive components, or sensors are not shown in the drawings.

The bottom case loader 10 is comprised primarily of an elevator mechanism, denoted generally as 20, a slip sheet mechanism, denoted generally as 40, and product positioning means, such as product collating and placing means, denoted generally as 50. Elevator mechanism 20 comprises elevator platen 22 and elevator raising and lowering means, such as cylinder 26, which is connected to platen 22.

Slip sheet mechanism 40 comprises slip sheet 42 and slip sheet positioning means, such as reciprocating cylinder 46 for moving the slip sheet 42 in and out of a product arrangement area, denoted generally as 70. Product positioning means 50 includes pusher plate 52 and pusher plate positioning means, such as cylinder 56 and connecting member 61.

There are two major deck levels: that of product arrangement deck 80 and of case transfer deck 90.

The bottom case loader operates as follows. Product, such as jars 12, enters loader 10 at the level of arrangement deck 80 on product conveying means, such as conveyor belt 14. Typically, the product is a package or container containing the actual goods to be used, and jars 12 may contain any good, such as butter, peanut butter, popcorn, etc. Conveyor belt 14 brings product from a production line to be packed.

The drawing shows a layer of product, i.e. the first or bottom layer, already on elevator platen 22 which is lowered the distance of the product height below arrangement area 70. Also, in the drawing, slip sheet 42 is shown in its inserted position where it serves as the floor of the arrangement area 70.

For purposes of following the sequence of loading the magazine from the beginning, the description will now depart slightly from the drawing. At the start of operation, slip sheet 42 is in its retracted position outside of arrangement area 70, elevator platen 22 , having no product thereon, is at its home position at deck level 80 serving as the floor of arrangement area 70, and pusher plate 52 is in its home (fully retracted) position shown. Jars 12 enter module 10 until a row of jars is positioned on the accumulator 54 adjacent pusher plate 52. Pusher plate 52 moves the accumulated row of jars across transfer plate 58 into the product arrangement area, denoted generally as 70. Walls 72 surround arrangement area 70 on three sides; the only open side being that facing pusher plate 52.

With the first row of product in position on elevator platen 22, pusher plate 52 retracts to its home position, and belt 14 positions a second row of product 12 on accumulator 54 in front of pusher plate 52. Pusher plate 52 moves this row of product onto elevator platen 22 adjacent the first row.

The above sequence is repeated until the array of product fills arrangement area 70. Of course, it is contemplated that other methods may be used to arrive at this point. For example, with some products, the entire array could first be assembled, such as on transfer plate 58 adjacent arrangement area 70, and the entire array could be shoved into arrangement area 70.

Elevator platen 22 then is lowered slightly more than the height of the product 12, and slip sheet 42 is inserted thru a slot 77 at the bottom of rear wall 79 of arrangement area 70 and becomes the new floor of arrangement area 70. During lowering of elevator platen 22, pusher plate 52 is kept in an extended position such that it forms the fourth wall of arrangement area 70 in order to stabilize the movement of the layer of loaded product.

The next layer of product is loaded onto slip sheet 42 in the same manner as it was loaded onto elevator platen 22 as described above. When this next layer is formed, slip sheet 42 is retracted and the product layer thereon drops a short distance onto the top of the first layer of product. Each jar 12 on the upper layer rests directly on top of its complementary jar in the lower layer. In this manner, two layers of product are stacked. The elevator platen 22 is then lowered so slip sheet 42 can again be inserted to floor for the next layer to be formed. If pads are to be used in the case, they may be inserted into the product arrangement area by means of the slip sheet or other appropriate means.

The above procedures are repeated until the number of layers needed to fill the case are stacked.

Figure 2:
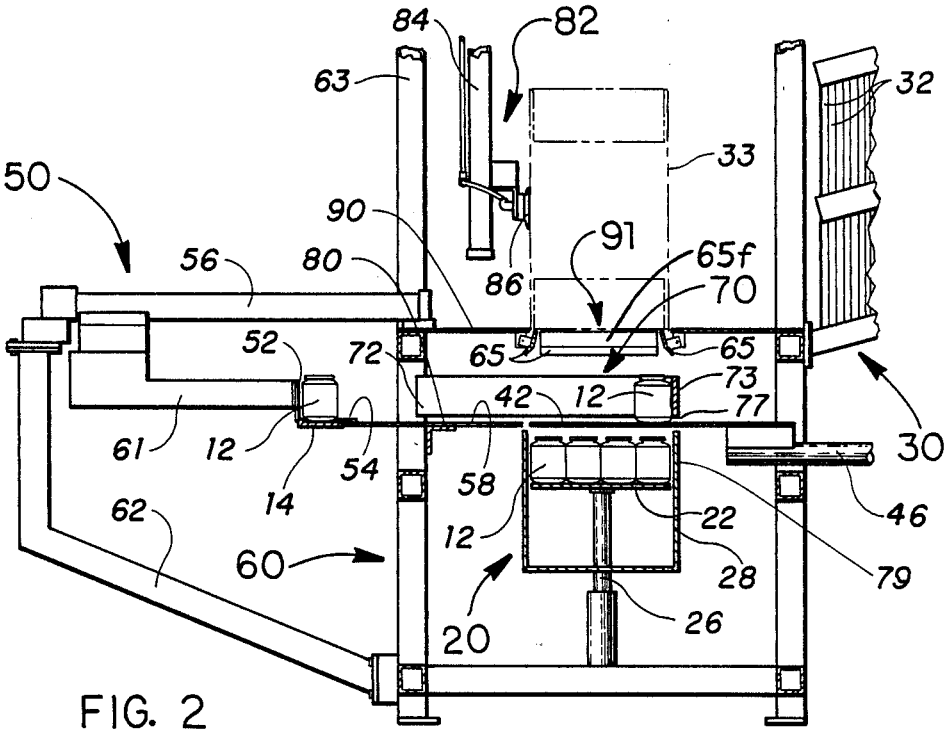
FIG. 2 is a sectional view taken along the line 2—2 of FIG. 1 additionally showing the relative position of the case opening mechanism and the method of product entry into the case.

FIG. 2 is a sectional view taken along line 2—2 of FIG. 1 and showing the major components of the bottom case loader of the present invention. As in FIG. 1, the specific nature of various drive means and the location and nature of the various product detectors and counters are not shown. This is done for clarity and because their inclusion and placement will be obvious to those skilled in the art.

A central framework, denoted generally as 60, supports the module components. Jars 12 arrive at product arrangement deck level 80 on conveyor belt 14 and form a row on accumulator 54. Product positioning means 50 is connected to central framework 60 and supported by lower frame 62. Product positioning means 50 includes pusher plate 52 and cylinder 56. Pusher plate 52 moves accumulated product 12 across transfer plate 58 and into product arrangement area 70 to rest upon, at this stage, slip sheet 42. The first row of the second layer of product is placed against back wall 73 of arrangement area 70. The first layer of product 12 is shown on elevator platen 22 in elevator chute 28. Elevator chute 28 includes side walls to contain product 12 in its array. Elevator mechanism 20 is driven by any of several drive means (not shown) which are well-known in the art.

Flat cases 32 are opened by means such as described in this inventor's U.S. Pat. No. 3,435,738 to form open receiving case 33. Case 33 is typically a corregated cardboard carton. Case opening and positioning apparatus includes upper framework 63, for supporting case opening apparatus, denoted generally as 82, and a case magazine, denoted generally as 30, for containing flat cases 32. Case opening apparatus 82 includes movable carriage 84 for moving suction cups 86 (one shown) to case magazine 30 for removal and opening case 33. Open case 33 is positioned openend downward above opening 91 in case transfer deck 90.

When the required layers of product are stacked on elevator platen 22, then pusher plate 52 remains extended and forms the fourth side of arrangement area 70. Elevator platen 22 is then raised and inserts the product into case 33 from the bottom. Case loading deck opening 91 is surrounded by guide horns 65 which are pivotably mounted to the bottom of loading deck 90. Upon rotation, guide horns 65 fully open the bottom flaps of case 33 and help to guide product 12 as it is being elevated into case 33.

With elevator platen 22 at loading deck level, case pusher means 92 (see FIG. 1), such as case pusher plate 94 and cylinder 96, pushes case 33 (FIG. 2) and the loaded product away from opening 91 and across case transfer deck 91 where the loaded case can be closed and sealed as described in the aboveidentified patents. During this movement, front guide horn **65*f* rotates further to form part of the transfer deck 90**.

From the foregoing description, it is seen that the present invention provides an effective and efficient method of loading one or more layers of product into a case. The method and apparatus of the invention is useful for a wide variety of products and containers and can pack many types of items that cannot be packed by other types of case packers.

Although a particular embodiment of the invention has been illustrated and described, various changes may be made to the form, construction, and arrangement of the parts herein without sacrificing any of its advantages, and it is to be understood that all matter herein is to be interpreted as illustrative and not in any limiting sense. Accordingly, the present invention is to be construed as limited only by the spirit and scope of the appended claims.

I claim:

1. A method of loading product into a case from a bottom comprising:

receiving product;

moving received product through an open side wall of a product arrangement area, having three walled sides, on an elevator platen; and arranging the moved product as a first layer of product;

walling the open side wall to the arrangement area such that a removable fourth side wall is formed;

lowering the elevator platen and the first layer of product thereon to a lower position such that the first layer can receive an additional layer of product that is to be slipped off a slip sheet;

removing the fourth side wall of the arrangement area;

moving a slip sheet to an inserted position where it serves as the floor of the arrangement area;

moving received product through the open side wall of the product arrangement area onto the slip sheet and arranging the moved product as a second layer of product;

walling the open side wall of the arrangement area;

moving the slip sheet to a retracted position outside of the arrangement area such that the layer of product thereupon drops onto the layer of product on the elevator;

positioning an open case above the arrangement area such that the case opening is downward oriented; and raising the elevator platen such that the stacked layers of product thereon are inserted into the opened case.

2. The method of claim 1 further comprising:

guiding the stacked layers of product into the bottom of the open case while simultaneously fully opening the case.

3. A method of loading product into a case from the bottom which comprises:

receiving product;

positioning received product as a first layer of product in an arrangement area on an elevator platen;

lowering the elevator platen and the first layer of product thereon to a lower position such that the first layer can receive an additional layer of product that is to be slipped off a slip sheet;

moving a slip sheet to an inserted position where it serves as the floor of the arrangement area;

positioning received product as a layer of product on the slip sheet in the arrangement area;

moving the slip sheet to a retracted position outside of the arrangement area such that the layer of product thereupon drops onto the layer of product on the elevator;

positioning an open case above the arrangement area such that the case opening is downward oriented; and raising the elevator platen to insert the stacked layers of product thereon into the opened case.

4. The method of claim 3 further comprising:

guiding the stacked layers of product into the bottom of the open case while simultaneously fully opening the case.

5. A case bottom loader module for loading stacked layers of product into a case from the bottom; said module comprising:

a product arrangement area;

product positioning means for receiving product and for positioning the product in said arrangement area on an elevator platen or on a slip sheet;

elevator means, including a platen, for raising and lowering said platen between a first position wherein said platen serves as the floor of said arrangement area for receiving a first layer of product from said product positioning means and a lower position for receiving an additional layer of product that is slipped off a slip sheet, and a higher position wherein product thereon is inserted into the bottom of an opened case;

case positioning means for positioning above said platen an open case for receiving product on said elevator platen; and slip sheet means, including a slip sheet, for moving said slip sheet to an inserted position where it serves as the floor of said arrangement area for receiving a layer of product and to a retracted position outside of said arrangement area such that a layer of product thereupon drops onto a layer of product on said elevator.

6. The case bottom loader of claim 5 wherein:

said product arrangement area has wall means on three sides for retaining product in said product arrangement area and an open side.

7. The case bottom loader of claim 6 wherein:

said product positioning means includes moving means for moving the product into said product arrangement area through said open side.

8. The case bottom loader of claim 7 wherein:

said product moving means includes a pusher plate that functions as the fourth side wall of said product arrangement area for retaining product in said product arrangement area.

9. The bottom case loader of claim 5 further including:

guide horn means pivotally mounted above said arrangement area for guiding stacked product raised by said elevator means into the bottom of a case opened by said case positioning means, such that, upon rotation, said guide horns fully open the bottom opening of the case for insertion of the stacked product.

* * * * *